US010188185B2

(12) United States Patent
Wu

(10) Patent No.: US 10,188,185 B2
(45) Date of Patent: Jan. 29, 2019

(54) SUITCASE

(71) Applicant: Chen-Chuan Wu, New Taipei (TW)

(72) Inventor: Chen-Chuan Wu, New Taipei (TW)

( * ) Notice: Subject to any disclaimer, the term of this patent is extended or adjusted under 35 U.S.C. 154(b) by 154 days.

(21) Appl. No.: 15/479,344

(22) Filed: Apr. 5, 2017

(65) Prior Publication Data

US 2018/0206605 A1 Jul. 26, 2018

(30) Foreign Application Priority Data

Jan. 25, 2017 (TW) ..... 106201471 U

(51) Int. Cl.

| | |
|---|---|
| ***A45C 13/00*** | (2006.01) |
| ***A45C 7/00*** | (2006.01) |
| ***A45C 5/03*** | (2006.01) |
| ***A45C 5/06*** | (2006.01) |
| ***A45C 13/10*** | (2006.01) |
| ***A45C 5/14*** | (2006.01) |
| ***A45C 13/26*** | (2006.01) |

(52) U.S. Cl.

CPC ..... *A45C 7/0045* (2013.01); *A45C 5/03* (2013.01); *A45C 5/06* (2013.01); *A45C 5/14* (2013.01); *A45C 13/10* (2013.01); *A45C 13/103* (2013.01); *A45C 13/262* (2013.01); *A45C 2005/035* (2013.01)

(58) Field of Classification Search

CPC ..... A45C 7/0045; A45C 5/03; A45C 5/06; A45C 2005/035; A45C 13/10; A45C 5/14; A45C 13/103; A45C 13/262

See application file for complete search history.

(56) References Cited

U.S. PATENT DOCUMENTS

| | | | | |
|---|---|---|---|---|
| 3,410,376 A * | 11/1968 | Benzel | ..... | A45C 7/0022 190/109 |
| 4,170,282 A | 10/1979 | Schwartzstein | | |
| 5,240,106 A | 8/1993 | Plath | | |
| 5,749,503 A | 5/1998 | Wulf et al. | | |
| 5,875,876 A | 3/1999 | Wang | | |
| 5,944,155 A | 8/1999 | Geary | | |

(Continued)

FOREIGN PATENT DOCUMENTS

| | | |
|---|---|---|
| JP | 3045972 U | 2/1998 |
| JP | 3168633 U | 6/2011 |

(Continued)

*Primary Examiner* — Tri Mai

(74) *Attorney, Agent, or Firm* — Alan D. Kamrath; Kamrath IP Lawfirm, P.A.

(57) ABSTRACT

A suitcase includes a main body, a removable compartment, at least one first main fastening unit, at least one second main fastening unit and a plurality of fastening rings. The main body includes a containing groove. The removable compartment is movably located in the containing groove, and the removable compartment includes a base layer, a covering layer, at least one hole and an inner opening unit. The covering layer covers the base layer. The at least one hole is located in the base layer. The inner opening unit is movably connected to the covering layer, and the inner opening unit is used for allowing the covering layer to be opened or closed; when the covering layer is opened, the base layer will be exposed to the outside. The at least one first main fastening unit is located in the containing groove.

10 Claims, 8 Drawing Sheets

(56) References Cited

U.S. PATENT DOCUMENTS

| | | | | |
|---|---|---|---|---|
| 7,398,868 | B2 * | 7/2008 | Morszeck | A45C 5/14 190/110 |
| D757,435 | S | 5/2016 | Damberg | |
| 9,439,515 | B2 | 9/2016 | Kim | |
| 2005/0236290 | A1 * | 10/2005 | Ohi | A01K 97/06 206/373 |
| 2007/0051765 | A1 * | 3/2007 | Hsieh | A45C 5/14 224/576 |
| 2009/0139814 | A1 * | 6/2009 | Grossman | A45C 7/0086 190/18 A |
| 2013/0292220 | A1 * | 11/2013 | Kerley | A45C 5/03 190/108 |
| 2017/0156462 | A1 * | 6/2017 | Yu | A45C 5/06 |
| 2017/0165829 | A1 | 6/2017 | Damberg | |

FOREIGN PATENT DOCUMENTS

| | | | |
|---|---|---|---|
| JP | 5847233 | B2 | 1/2016 |
| WO | WO2007005217 | A2 | 1/2007 |
| WO | WO2008056478 | A1 | 5/2008 |

* cited by examiner

SUITCASE

BACKGROUND OF THE INVENTION

1. Field of the Invention

The present invention relates to a suitcase; more particularly, the present invention relates to a suitcase with a compartment which can be separated from the main body of the suitcase.

2. Description of the Related Art

Currently, a suitcase on the market has a compartment with a zipper on the outer surface of the suitcase cover, within which the user can store some small objects, such as paper, a pen, a map, tissue paper, or a folding umbrella; thus, the compartment on the suitcase cover is very convenient for the user.

The compartment on the suitcase cover is usually combined with the suitcase cover via stitching. However, the compartment on the suitcase cover has a certain amount of weight, which may increase the whole weight of the suitcase and affect the portability of the suitcase; furthermore, not all users need to use the compartment on the suitcase cover.

Therefore, there is a need to provide a new suitcase which has a removable compartment on the suitcase cover, and the compartment and the suitcase cover can be combined with or separated from each other.

SUMMARY OF THE INVENTION

It is an object of the present invention to provide a suitcase having a compartment which can be separated from the main body.

To achieve the abovementioned object, a suitcase of the present invention includes a main body, a removable compartment, at least one first main fastening unit, at least one second main fastening unit and a plurality of fastening rings. The main body includes a containing groove. The removable compartment is movably located in the containing groove, and the removable compartment includes a base layer, a covering layer, at least one hole and an inner opening unit. The covering layer covers the base layer. The at least one hole is located in the base layer. The inner opening unit is movably connected to the covering layer, and the inner opening unit is used for allowing the covering layer to be opened or closed; when the covering layer is opened, the base layer will be exposed to the outside. The at least one first main fastening unit is located in the containing groove, and the at least one first main fastening unit includes a fastening bar and an operating unit. The operating unit is connected to the fastening bar and passes through the at least one hole. The at least one second main fastening unit is located in the containing groove. A plurality of fastening rings are connected to the base layer, and the positions of the plurality of fastening rings respectively correspond to the at least one first main fastening unit and at least one second main fastening unit.

According to one embodiment of the present invention, the first main fastening unit further includes an elastic unit, and the elastic unit is connected to the operating unit.

According to one embodiment of the present invention, the first main fastening unit further includes a fastening unit main body and a fastening slot; the fastening slot is located on the fastening unit main body, and the fastening bar is located in the fastening slot.

According to one embodiment of the present invention, the first main fastening unit further includes a through hole; the through hole links to the fastening slot, and the fastening bar passes through the through hole and is located in the fastening slot.

According to one embodiment of the present invention, the first main fastening unit further includes a sliding slot; the sliding slot is located on the fastening unit main body, and the operating unit passes through the sliding slot.

According to one embodiment of the present invention, the removable compartment further includes an outer cover; the outer cover covers the base layer and the covering layer.

According to one embodiment of the present invention, the removable compartment further includes an outer opening unit; the outer opening unit is movably connected to the outer cover and the base layer, and the outer opening unit is used for allowing the outer cover to be opened or closed relative to the base layer.

According to one embodiment of the present invention, the containing groove further includes a plurality of notches; the at least one first main fastening unit and the at least one second main fastening unit are located in the plurality of notches.

According to one embodiment of the present invention, the inner opening unit and the outer opening unit are zippers.

According to one embodiment of the present invention, an amount of the at least one first main fastening unit is two, an amount of the at least one second main fastening unit is two, and an amount of the plurality of fastening rings is four.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
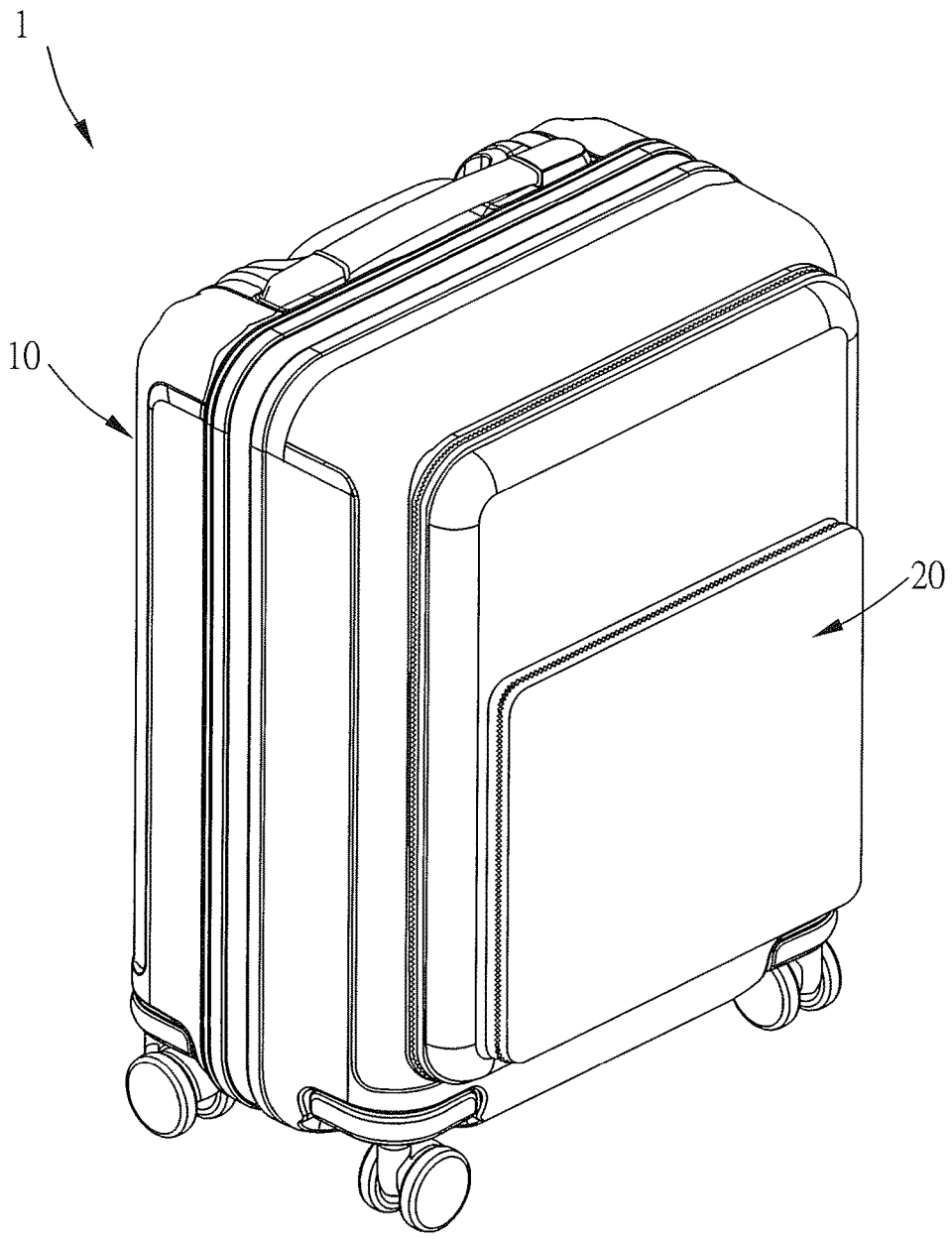
FIG. 1 illustrates a schematic drawing of the suitcase in one embodiment of the present invention.
Figure 2:
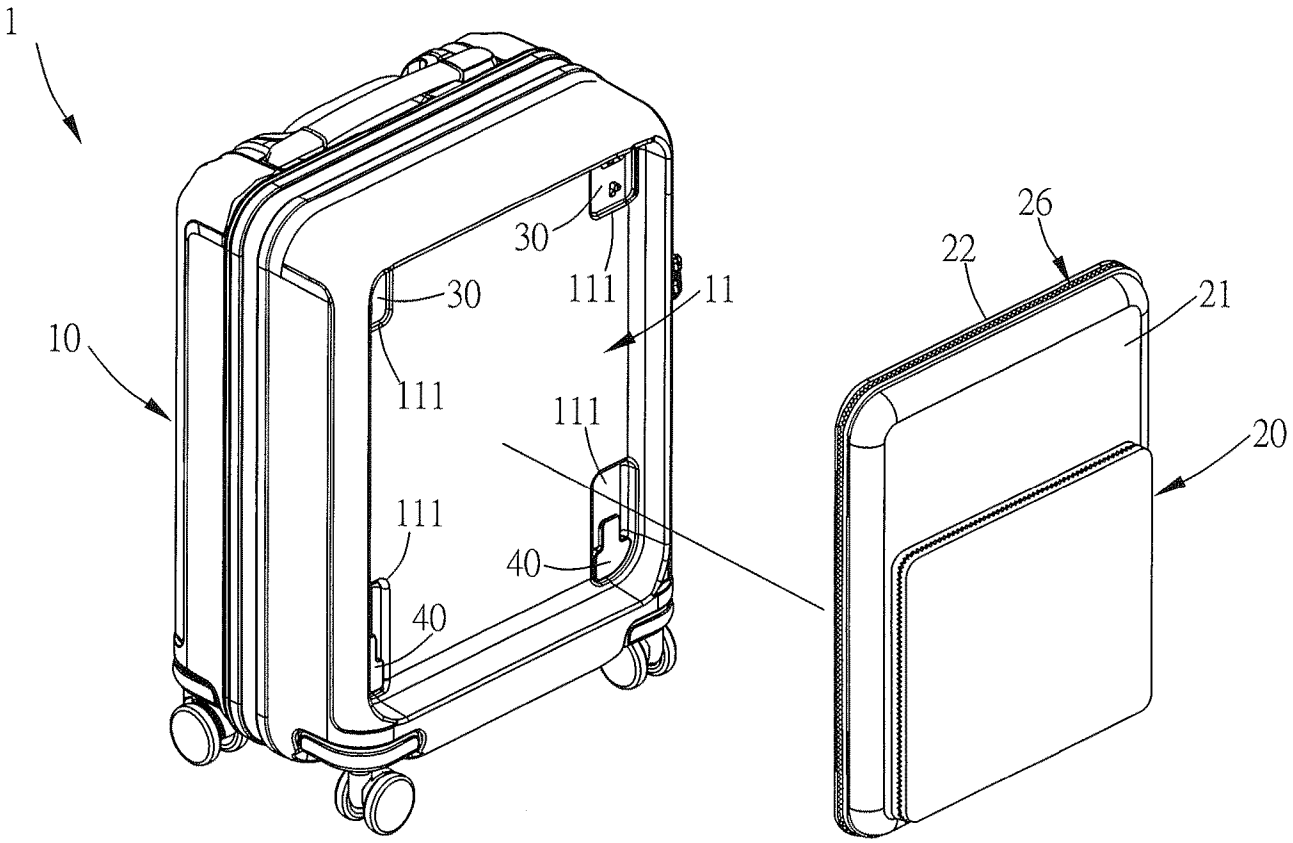
FIG. 2 illustrates an exploded view of the main body and the removable compartment of the suitcase in one embodiment of the present invention.
Figure 3:
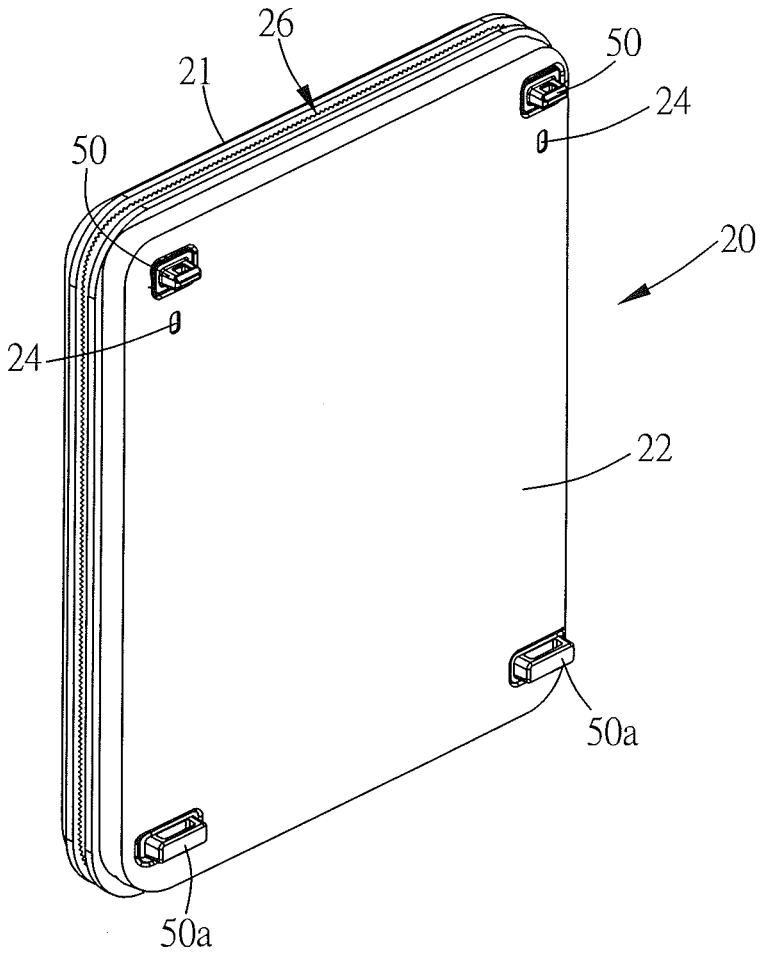
FIG. 3 illustrates a schematic drawing of the back of the removable compartment in one embodiment of the present invention.
Figure 4:
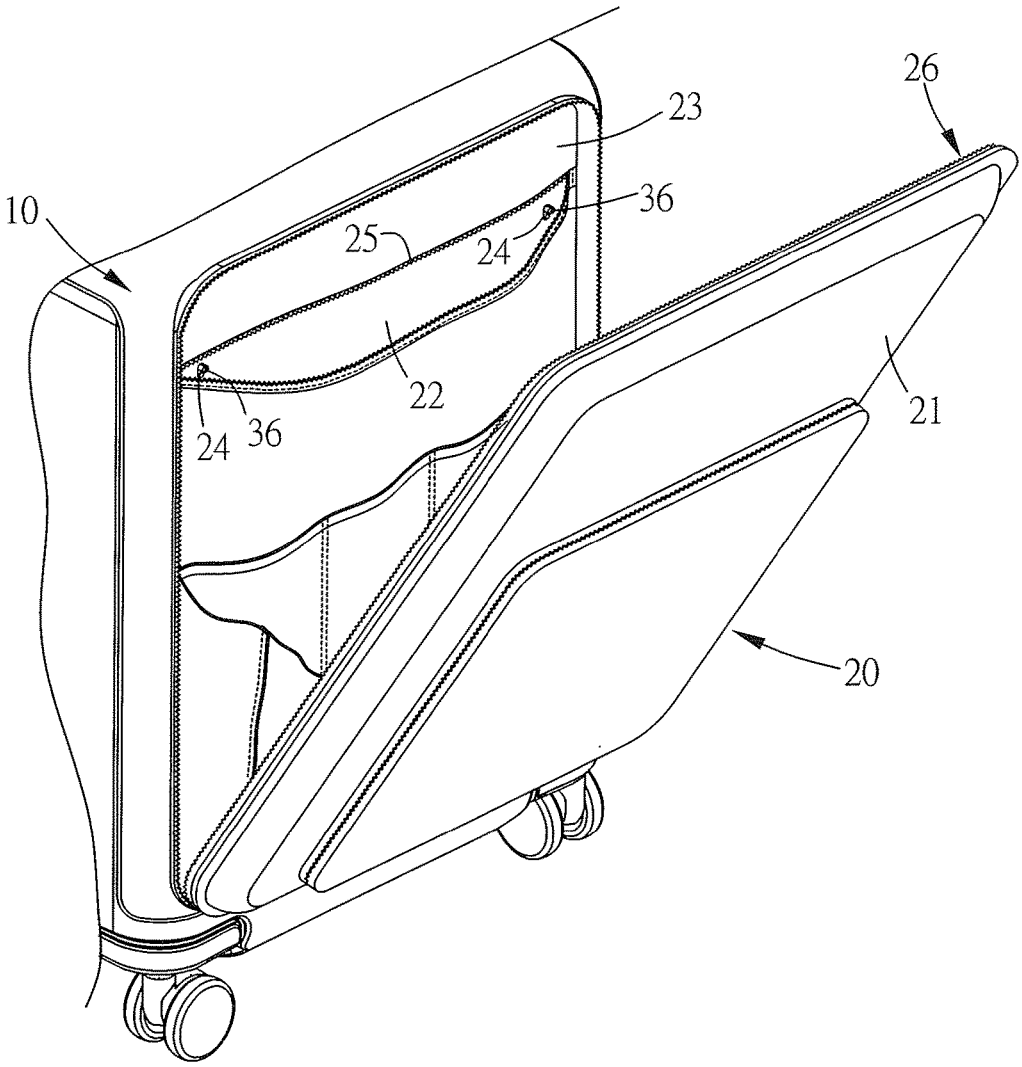
FIG. 4 illustrates a schematic drawing of the removable compartment when the outer cover and the covering layer are opened in one embodiment of the present invention.
Figure 5:
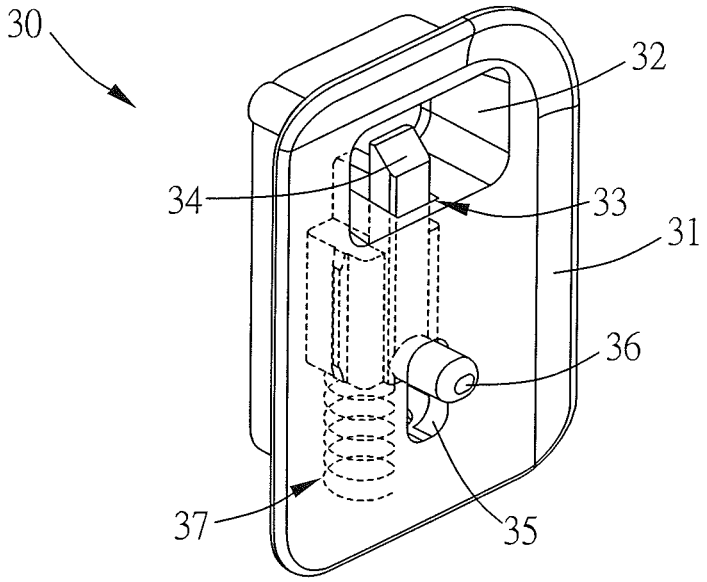
FIG. 5 illustrates a schematic drawing of the first main fastening unit in one embodiment of the present invention.
Figure 6:
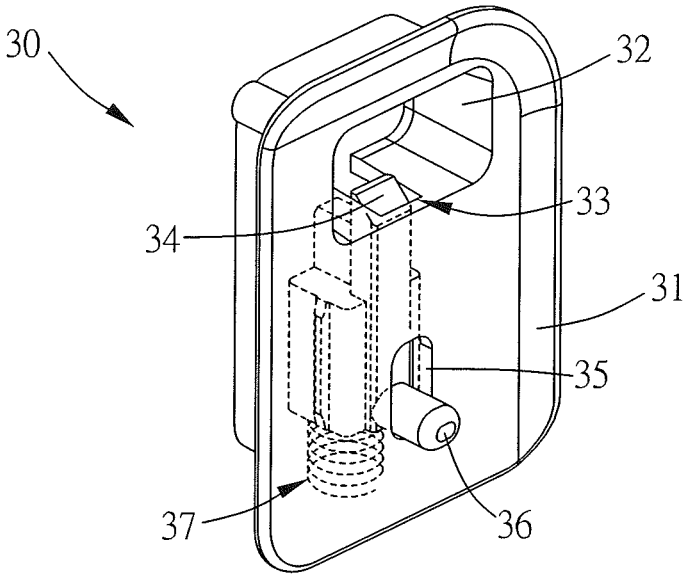
FIG. 6 illustrates a schematic drawing of the first main fastening unit when the operating unit slides along the sliding slot in one embodiment of the present invention.
Figure 7:
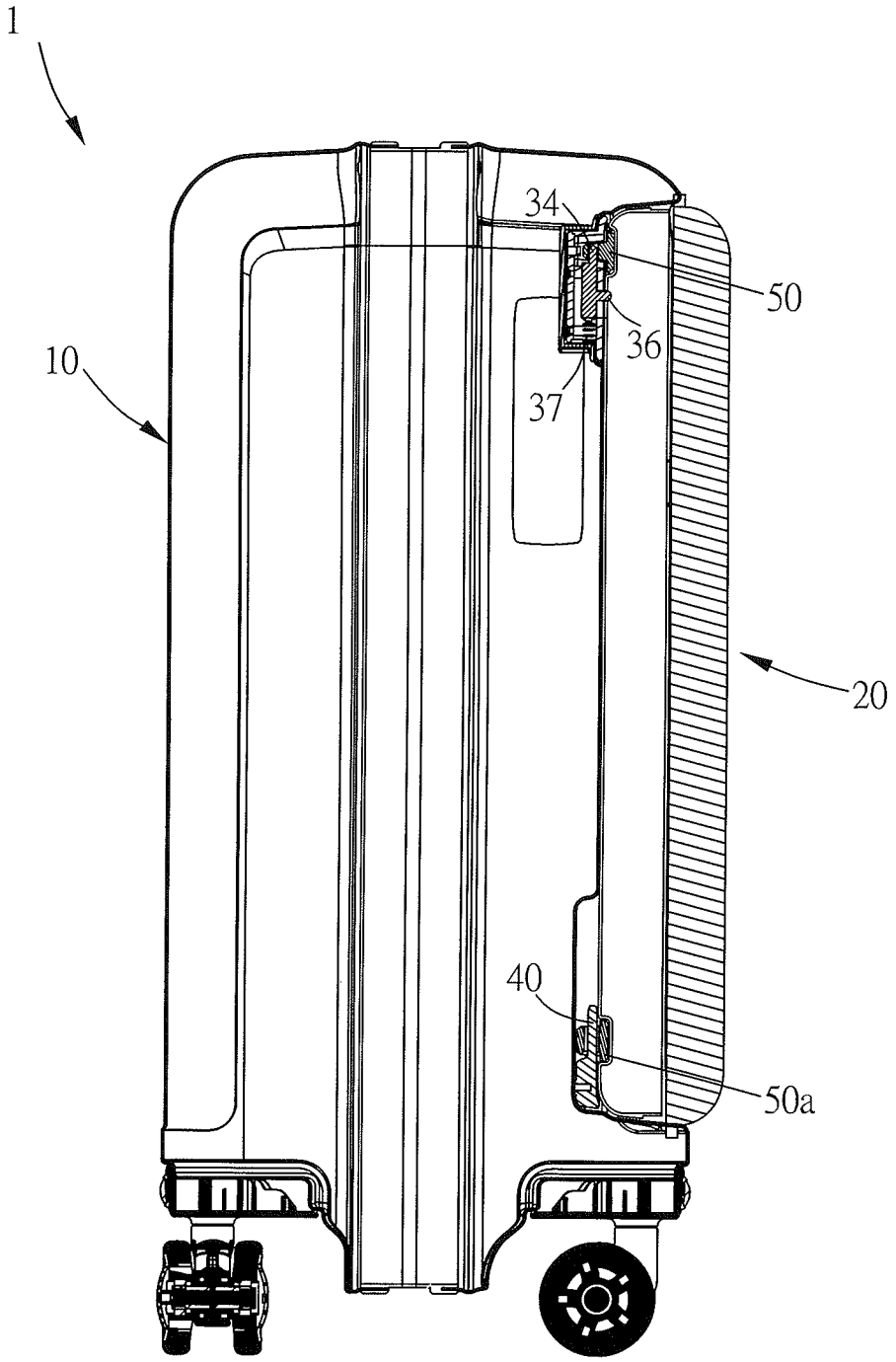
FIG. 7 illustrates a sectional view of the suitcase when the main body and the removable compartment are combined with each other in one embodiment of the present invention.
Figure 8:
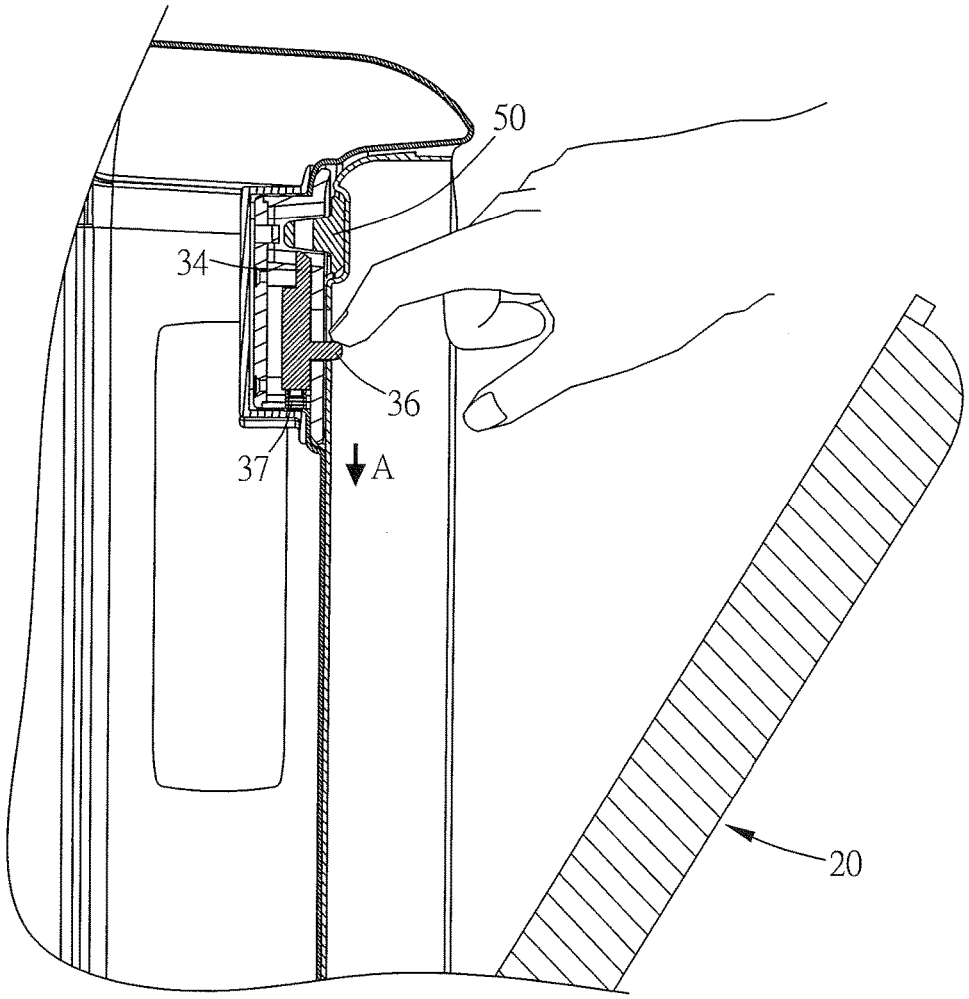
FIG. 8 illustrates a partial sectional view of the suitcase when the operating unit slides along the sliding slot in one embodiment of the present invention.
Figure 9:
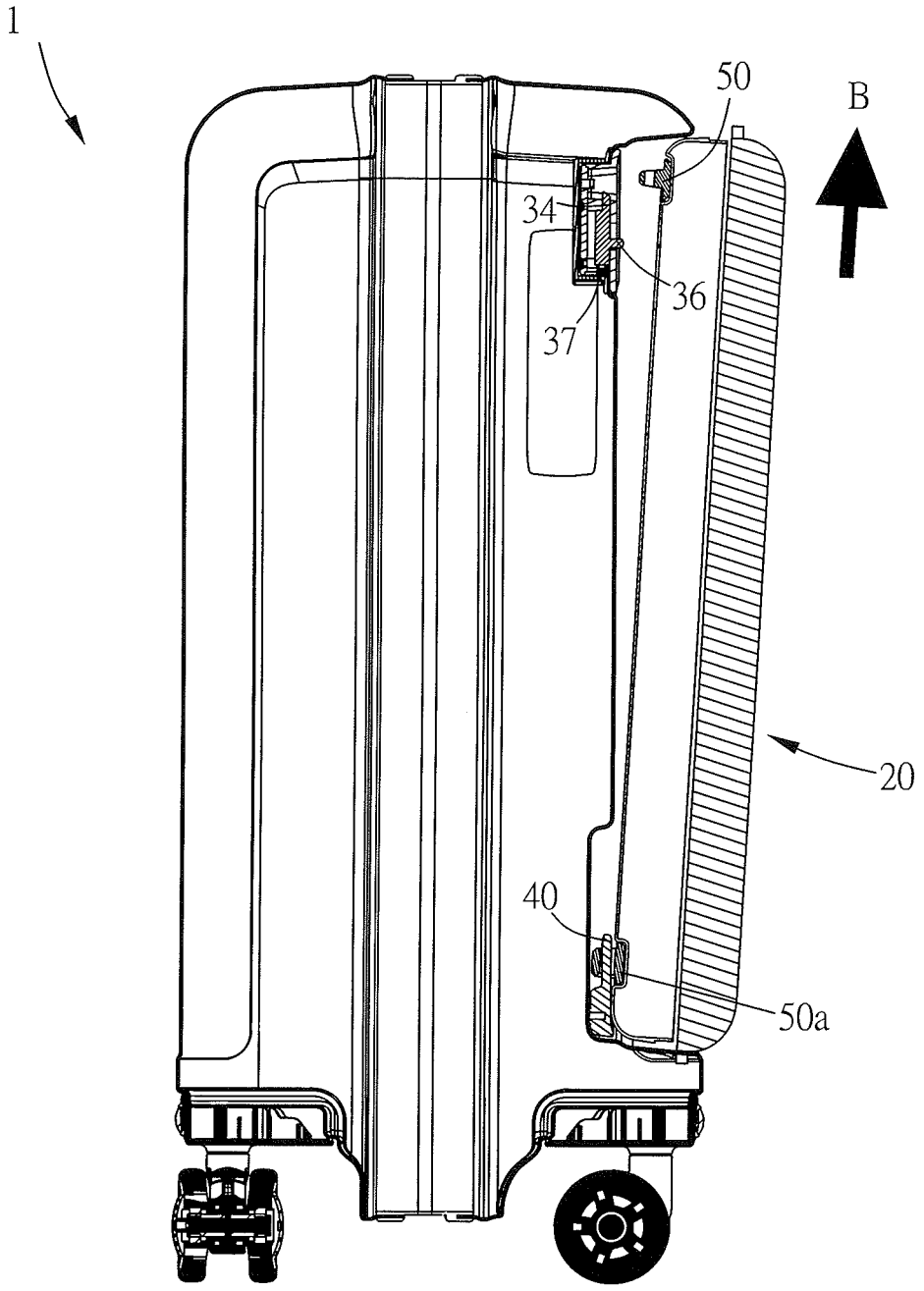
FIG. 9 illustrates a partial sectional view of the suitcase when the first main fastening unit and the fastening ring are separated in one embodiment of the present invention.

Please refer to FIG. 1 to FIG. 9, which illustrate one embodiment of the suitcase of the present invention. FIG. 1 illustrates a schematic drawing of the suitcase in one embodiment of the present invention. FIG. 2 illustrates an exploded view of the main body and the removable compartment of the suitcase in one embodiment of the present invention. FIG. 3 illustrates a schematic drawing of the back of the removable compartment in one embodiment of the present invention. FIG. 4 illustrates a schematic drawing of the removable compartment when the outer cover and the covering layer are opened in one embodiment of the present invention. FIG. 5 illustrates a schematic drawing of the first main fastening unit in one embodiment of the present invention. FIG. 6 illustrates a schematic drawing of the first main fastening unit when the operating unit slides along the sliding slot in one embodiment of the present invention. FIG. 7 illustrates a sectional view of the suitcase when the main body and the removable compartment are combined with each other in one embodiment of the present invention. FIG. 8 illustrates a partial sectional view of the suitcase when the operating unit slides along the sliding slot in one embodiment of the present invention. FIG. 9 illustrates a partial sectional view of the suitcase when the first main fastening unit and the fastening ring are separated in one embodiment of the present invention.

As shown in FIG. 1 to FIG. 3 and FIG. 5, in one embodiment of the present invention, the suitcase 1 has a removable outer compartment, and the user can remove that outer compartment from the suitcase 1 or install that outer compartment on the suitcase 1 according to personal requirements. The suitcase 1 includes a main body 10, a removable compartment 20, two first main fastening units 30, two second main fastening units 40 and four fastening rings 50, 50*a*.

In one embodiment of the present invention, the main body 10 includes a containing groove 11, and the containing groove 11 is used for combining with the removable compartment 20. The containing groove 11 is substantially shaped as a rectangle, but the shape is not limited to that shape; the shape can be changed according to the design of the removable compartment 20. The containing groove 11 includes four notches 111. The four notches 111 are respectively located on the four corners of the rectangular containing groove 11. The two first main fastening units 30 and the two second main fastening units 40 are respectively located in the four notches 111.

As shown in FIG. 2 to FIG. 4, in one embodiment of the present invention, the removable compartment 20 is movably located in the containing groove 11. The removable compartment 20 includes an outer cover 21, a base layer 22, a covering layer 23, two holes 24, an inner opening unit 25 and an outer opening unit 26. The outer cover 21 is a cover of the removable compartment 20 facing the outside, and the outer cover 21 covers the base layer 22 and the covering layer 23. The base layer 22 is a rectangle-like layer of the removable compartment 20 facing the containing groove 11. The covering layer 23 is a piece of cloth which covers the base layer 22, and the covering layer 23 is located between the base layer 22 and the outer cover 21. A containing space is formed between the outer cover 21 and the covering layer 23 for allowing the user to store thin and small items. The two holes 24 are located in the base layer 22. The two holes 24 are respectively used for containing the two first main fastening units 30, and the two holes 24 are respectively used for allowing the two first main fastening units 30 to be exposed to the outside such that the user can operate the two first main fastening units 30. The inner opening unit 25 is a zipper, and the inner opening unit 25 is movably connected to the covering layer 23. The inner opening unit 25 is used for allowing the covering layer 23 to be opened or closed. When the zipper of the inner opening unit 25 is completely closed such that the covering layer 23 can be closed, the base layer 22 will be covered by the closing covering layer 23 such that the base layer 22 will not be exposed to the outside. When the zipper of the inner opening unit 25 is opened such that the covering layer 23 can be opened, the base layer 22 will be exposed to the outside, and the two first main fastening units 30 in the two holes 24 will also be exposed to the outside. The outer opening unit 26 is a zipper which is movably connected to the outer cover 21 and the base layer 22. The zipper of the outer opening unit 26 is used for allowing the outer cover 21 to be opened or closed relative to the base layer 22. However, the type of the inner opening unit 25 and the outer opening unit 26 is not limited to the zipper; the inner opening unit 25 and the outer opening unit 26 can also be other units with opening and closing functions, such as buckles.

As shown in FIG. 2, FIG. 3, and FIG. 5 to FIG. 7, in one embodiment of the present invention, the two first main fastening units 30 are located in the two notches 111 on the two upper corners of the containing groove 11. The first main fastening units 30 are used for fastening to the fastening rings 50. Each first main fastening unit 30 includes a fastening unit main body 31, a fastening slot 32, a through hole 33, a fastening bar 34, a sliding slot 35, an operating unit 36 and an elastic unit 37. The fastening slot 32 is located on the fastening unit main body 31; the fastening slot 32 is used for containing the fastening ring 50 when the top of the removable compartment 20 is placed in the containing groove 11. The through hole 33 links to the fastening slot 32. The fastening bar 34 passes through the through hole 33 to be located in the fastening slot 32. The sliding slot 35 is located on the fastening unit main body 31. The operating unit 36 passes through the sliding slot 35 and the hole 24, and the operating unit 36 is connected to the fastening bar 34. The operating unit 36 is provided for the user to press and thereby cause the operating unit 36 to move along the sliding slot 35 such that the fastening bar 34 recedes into the through hole 33. The elastic unit 37 is a spring which is connected to the operating unit 36. The elastic unit 37 is used for pushing the fastening bar 34 such that the fastening bar 34 will extend from the through hole 33 and fasten to the fastening ring 50. However, the amount of the first main fastening unit 30 is not limited to two; the amount can be changed according to design requirements.

In one embodiment of the present invention, the two second main fastening units 40 are located in the two notches 111 in the two lower corners of the containing groove 11. Each second main fastening unit 40 is a column for fastening to the fastening ring 50*a*. However, the amount of the second main fastening unit 40 is not limited to two; the amount can be changed according to design requirements. The four fastening rings 50, 50*a* are respectively located in the four corners of the rectangle-like base layer 22, wherein two fastening rings 50 are located in the upper two corners of the base layer 22, for respectively fastening the two first main fastening units 30; the other two fastening rings 50*a* are located in the lower two corners of the base layer 22 for respectively fastening the two second main fastening units 40. However, the amount of the fastening rings 50, 50*a* is not limited to four; the amount can be changed according to design requirements.

When the user wants to separate the main body 10 and the removable compartment 20 of the suitcase 1, as shown in FIG. 4 and FIG. 8, the user can first open the zipper of the outer opening unit 26, open the outer cover 21, open the zipper of the inner opening unit 25 and open the covering layer 23 to expose the two holes 24 in the base layer 22 to the outside. Then the user can press the two operating units 36 which pass through the two holes 24 to cause the two operating units 36 to move downward along the pushing direction A. At this moment, as shown in FIG. 6 and FIG. 8, the two operating units 36 move along the pushing direction A and cause the two fastening bars 34 to recede into the through holes 33 such that the two fastening bars 34 are respectively separated from the two fastening rings 50, whereby the two fastening bars 34 will not be fastened to the fastening rings 50. Then, as shown in FIG. 9, the user can pull the removable compartment 20 towards the outside and lift the removable compartment 20 along the separating direction B to separate the two second main fastening units 40 from the two fastening rings 50*a*, whereby the two second main fastening units 40 will not be fastened to the two fastening rings 50*a*. Therefore, the main body 10 and the removable compartment 20 of the suitcase 1 can be completely separated from each other.

When the user wants to combine the main body 10 and the removable compartment 20 of the suitcase 1 with each other, as shown in FIG. 2, FIG. 3 and FIG. 9, the user can first put the bottom of the removable compartment 20 into the containing groove 11 such that the two fastening rings 50*a* located on the two lower corners of the base layer 22 respectively fasten to the two second main fastening units 40. Then, as shown in FIG. 2, FIG. 3, FIG. 5 and FIG. 7, the user can push the top of the removable compartment 20 into the containing groove 11; at this moment, the two fastening rings 50 on the two upper corners of the base layer 22 respectively enter the two fastening slots 32 of the two first main fastening units 30. Then each fastening ring 50 which enters into the fastening slot 32 slightly presses the incline on the top of the fastening bar 34 such that the fastening bar 34 will slightly recede into the through hole 33. After each fastening ring 50 completely enters the fastening slot 32, the elastic unit 37 will push the fastening bar 34 to cause the fastening bar 34 to extend from the through hole 33 and into the fastening ring 50, whereby the two fastening rings 50 will be respectively fastened to the two first main fastening units 30. Therefore, the main body 10 and the removable compartment 20 of the suitcase 1 can be combined with each other stably. Finally, as shown in FIG. 4, the user closes the zippers of the inner opening unit 25 and the outer opening unit 26 to ensure that the covering layer 23 completely covers the base layer 22, the two holes 24 and the two operating units 36 to prevent exposure of the base layer 22, the two holes 24 and the two operating units 36 to the outside.

Via the design of the suitcase 1 of the present invention, the user can easily separate or combine the main body 10 and the removable compartment 20 according to personal requirements.

Please note that the above embodiment is just a preferred embodiment of the present invention and is not intended to limit the scope of the present invention. It will be understood by those skilled in the art that the abovementioned elements are not all essential elements. Furthermore, in order to implement the present invention, other detailed known elements may be included as well. Each element can be omitted or modified according to different needs.

In summary, regardless of the purposes, means and effectiveness, this invention is quite different from the known technology and should merit the issuing of a new patent. However, it is noted that the above-mentioned embodiment is only for illustrative purposes; the claims of the invention should not be limited to the embodiment.

What is claimed is:

1. A suitcase, comprising:

a main body, comprising a containing groove;

a removable compartment, movably located in the containing groove, wherein the removable compartment comprises:

a base layer;

a covering layer, covering the base layer;

at least one hole, located in the base layer;

an inner opening unit, movably connected to the covering layer, wherein the inner opening unit is used for allowing the covering layer to be opened or closed, and the base layer is exposed to the outside when the covering layer is opened;

at least one first main fastening unit, located in the containing groove, wherein the at least one first main fastening unit comprises:

a fastening bar; and an operating unit, connected to the fastening bar and passing through the at least one hole;

at least one second main fastening unit, located in the containing groove; and a plurality of fastening rings, connected to the base layer, and a plurality of positions of the plurality of fastening rings respectively correspond to the at least one first main fastening unit and the at least one second main fastening unit.

2. The suitcase as claimed in claim 1, wherein the first main fastening unit further comprises an elastic unit, and the elastic unit is connected to the operating unit.

3. The suitcase as claimed in claim 2, wherein the first main fastening unit further comprises a fastening unit main body and a fastening slot, the fastening slot is located on the fastening unit main body, and the fastening bar is located in the fastening slot.

4. The suitcase as claimed in claim 3, wherein the first main fastening unit further comprises a through hole, the through hole links to the fastening slot, and the fastening bar passes through the through hole and is located in the fastening slot.

5. The suitcase as claimed in claim 4, wherein the first main fastening unit further comprises a sliding slot, the sliding slot is located on the fastening unit main body, and the operating unit passes through the sliding slot.

6. The suitcase as claimed in claim 5, wherein the removable compartment further comprises an outer cover, and the outer cover covers the base layer and the covering layer.

7. The suitcase as claimed in claim 6, wherein the removable compartment further comprises an outer opening unit, the outer opening unit is movably connected to the outer cover and the base layer, and the outer opening unit is used for allowing the outer cover to be opened or closed relative to the base layer.

8. The suitcase as claimed in claim 7, wherein the containing groove further comprises a plurality of notches, and the at least one first main fastening unit and the at least one second main fastening unit are located in the plurality of notches.

9. The suitcase as claimed in claim 8, wherein the inner opening unit and the outer opening unit are zippers.

10. The suitcase as claimed in claim 9, wherein an amount of the at least one first main fastening unit is two, an amount of the at least one second main fastening unit is two, and an amount of the plurality of fastening rings is four.

* * * * *